US006457181B1

(12) United States Patent
Grundy

(10) Patent No.: US 6,457,181 B1
(45) Date of Patent: Oct. 1, 2002

(54) GLOVE APPARATUS AND METHOD

(76) Inventor: Russell E. Grundy, 8748 Brunswick Rd., Minocqua, WI (US) 54548

( * ) Notice: Subject to any disclaimer, the term of this patent is extended or adjusted under 35 U.S.C. 154(b) by 0 days.

(21) Appl. No.: 09/514,486

(22) Filed: Feb. 28, 2000

(51) Int. Cl.[7] ..... A41D 19/00
(52) U.S. Cl. ..... 2/161.1; 2/163
(58) Field of Search ..... 2/16, 20, 21, 159, 2/160, 161.1, 161.2, 161.3, 161.4, 161.5, 161.6, 163, 167, 169

(56) References Cited

U.S. PATENT DOCUMENTS

| | | | | | |
|---|---|---|---|---|---|
| 3,707,730 | A | * | 1/1973 | Slider | 2/161 |
| 4,624,016 | A | * | 11/1986 | Luevano | 2/161 |
| 5,920,915 | A | * | 7/1999 | Bainbridge et al. | 2/456 |
| 6,052,827 | A | * | 4/2000 | Widdemer | 2/161.1 |
| 6,154,882 | A | * | 12/2000 | Ullman | 2/20 |

* cited by examiner

*Primary Examiner*—John J Calvert
*Assistant Examiner*—Katherine Moran

(57) ABSTRACT

The hand covering of the present invention has a body portion preferably substantially covering a wearer's hand but which at least partially covers the fingers of the wearer, and a limiting element preventing the wearer from grasping with the fingers. The hand covering is in the form of a glove. The limiting element is coupled to the body portion and is located on the front of the wearer's hand. The hand covering preferably covers at least a portion of the wearer's palm and/or fingers, more preferably covers a portion of base of the fingers and/or the palm adjacent to the base of the fingers, and most preferably covers a portion of the palm adjacent to the thumb and at least the index finger. The limiting element is preferably a deformable and resilient member, and interferes with the wearer's ability to bring the thumb together with the other fingers of the hand. Although the limiting element can be attached to an area of the body portion covering the thumb or to another area of the body portion (i.e., to the area covering the four fingers opposed to the thumb or to the area covering the palm), the limiting element is preferably not attached to both, thereby providing the wearer with limited finger movement falling short of the ability to grasp as described above. Highly preferred embodiments of the present invention employ one or more retaining elements to keep the hand covering upon the wearer's hand.

19 Claims, 4 Drawing Sheets

GLOVE APPARATUS AND METHOD

FIELD OF THE INVENTION

The present invention relates generally to coverings for human hands, and more particularly, to gloves and mittens for preventing grasping of clothing and other articles.

BACKGROUND OF THE INVENTION

A number of sports are played by rules that in some way restrict the use of hands during play. Common in many such sports is the restriction from a player grasping an opponent's clothing or other articles (pads, helmet, etc.) worn by the opponent. Although existing in one form or another in many sports, this rule and the impact its infraction has upon the game is particularly significant in contact sports such as American football. By way of example and for ease of discussion only, the following description is with reference to American football. However, the present invention is relevant to and finds application with regard to a number of other games.

The National Football Federation Rules Committee has promulgated rules regarding a football player's use of hands and holding techniques that result in cause for penalties. These rules state that, "in blocking, a player may contact opponents with the arms or hands provided the technique is legal. Legal techniques are as follows: a) Closed Or Cupped Hand Technique. Under Rule 2, the hands must be closed or cupped with the palms not facing the opponent; b) Open Hand Technique. Under Rule 5, the palms shall be open when they are facing the frame of the opponent or when the forearms are extended beyond the 45-degree angle from the body."

These rules are often violated by persons on an offensive line of a football team when they grasp another player or the player's clothing or equipment while blocking. Although these rules are enforced, the ability of a referee to see and positively identify an infraction of these rules is limited by the number of players the referee must watch, the referee's line of sight, and the ability of many players to mask their practice of grasping and holding an opponent's clothing or other articles. In some cases, violation of the above-stated rules is so common that referees are resigned to permitting infractions unless they significantly affect game play. Because penalties resulting from infractions of these rules can alter the outcome of a football game (to say nothing of a team or player to succeed even though these rules are being violated by the opponent), regular and systematic rules enforcement is important. Without regular and systematic enforcement of these rules, true fairness of game play and accuracy of player and team statistics cannot be maintained.

Rules against opponent blocking by grasping a player's clothing or equipment also exist for the purpose of preventing injuries to the player and to the opponent being blocked. Use of an open hand to grasp can result in hand injuries to the blocker in a heavy-contact sport such as American football. Also, serious injuries can occur to a player who's jersey, facemask, or pads has been grasped by an opponent in order to control the player's body and movement. Regardless of the impact illegal grasping has upon a game's outcome, regular and systematic rules enforcement is also important to reducing the risk of serious injuries.

Particularly in light of what appears to be an ever-relaxing enforcement of holding and blocking rules in American football, a need exists for a device that can be used to train players against the practice of blocking an opponent by grasping an opponent's clothing or articles, to prevent violations of rules against such grasping during game play, to encourage proper blocking techniques, and to reduce injuries both to the blocking player and to the opponent. Each preferred embodiment of the present invention achieves one or more of these results.

SUMMARY OF THE INVENTION

The present invention is a hand covering that prevents the wearer from grasping with the fingers. The hand covering is a glove, and has a body portion that preferably substantially covers a wearer's hand. Preferably, the body portion at least partially covers the four fingers opposing the thumb of the wearer's hand, and more preferably at least partially covers all the fingers of the wearer's hand. Also preferably, the body portion of the hand covering covers at least a portion of the front and back of the wearer's hand. To prevent the act of grasping, the hand covering has a limiting element coupled to the body portion and located on the front (palm side up) of the wearer's hand. The hand covering preferably covers at least a portion of the wearer's palm and/or fingers, more preferably covers at least a portion of the base of the fingers and/or the palm adjacent to the base of the fingers, and most preferably covers at least a portion of the palm adjacent to the thumb and at least the index finger.

The limiting element is preferably a deformable and resilient member, and can take a number of different shapes capable of interfering with the wearer's ability to bring the thumb together with the other fingers of the hand. The limiting element is directly or indirectly attached in any conventional manner to the body portion of the hand covering. Also, the limiting element can be covered or enclosed by covering material which is attached to or integral with the body portion of the hand covering. Although the limiting element can be attached to an area of the body portion covering the thumb or to another area of the body portion (i.e., to the area covering at least a portion of at least one of the four fingers opposed to the thumb or to the area at least partially covering the palm), the limiting element is preferably not attached to both, thereby providing the wearer with limited finger movement falling short of the ability to grasp as described above. This movement can be very helpful in holding the football, if necessary.

Highly preferred embodiments of the present invention employ one or more retaining elements to keep the hand covering upon the wearer's hand. Specifically, the hand covering can have a strap or elastic band for surrounding the wrist of the wearer.

The present invention significantly increases rules compliance during a football game by eliminating grasping by persons attempting to block other players. Furthermore, the present invention creates a tool for training and practicing proper blocking technique for football players. By preventing the ability of a wearer to grasp an opponent's clothing or equipment, the present invention can also reduce finger and thumb injuries.

Further objects and advantages of the present invention, together with the organization and manner of operation thereof, will become apparent from the following detailed description of the invention taken in conjunction with the accompanying drawings, wherein like elements have like numerals throughout the drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 2:
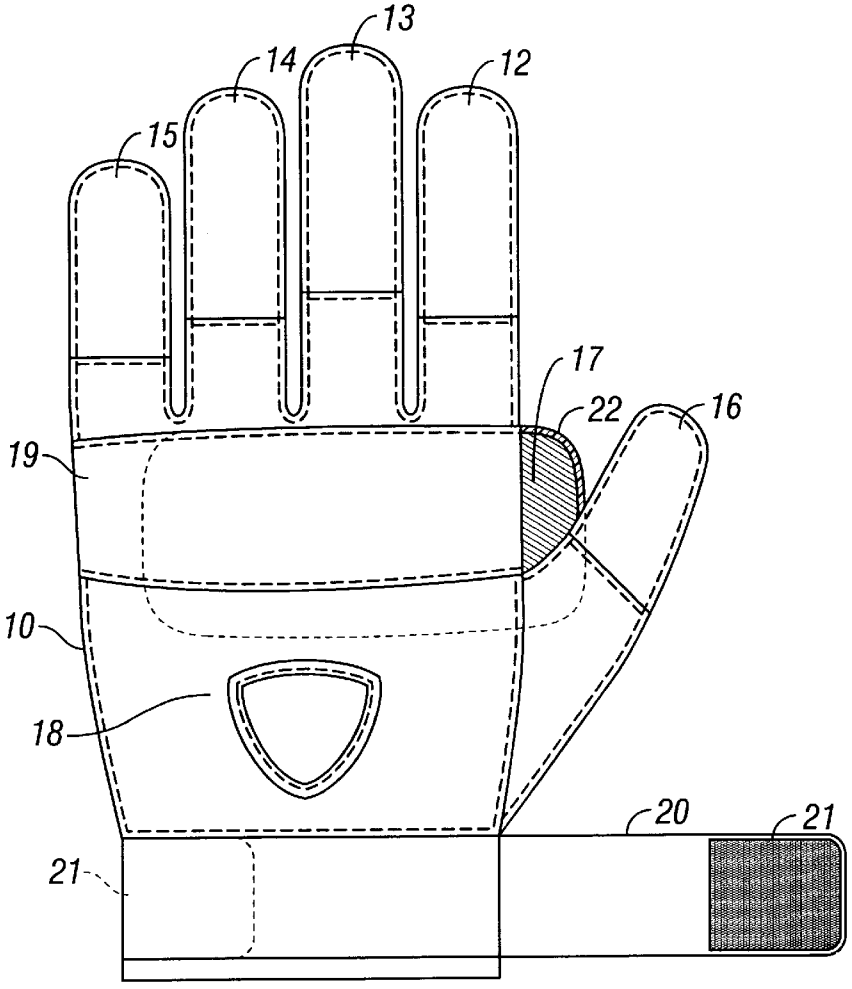
FIG. 2 is a back elevational view of a right-handed glove according to the first preferred embodiment of the present invention.
Figure 1:
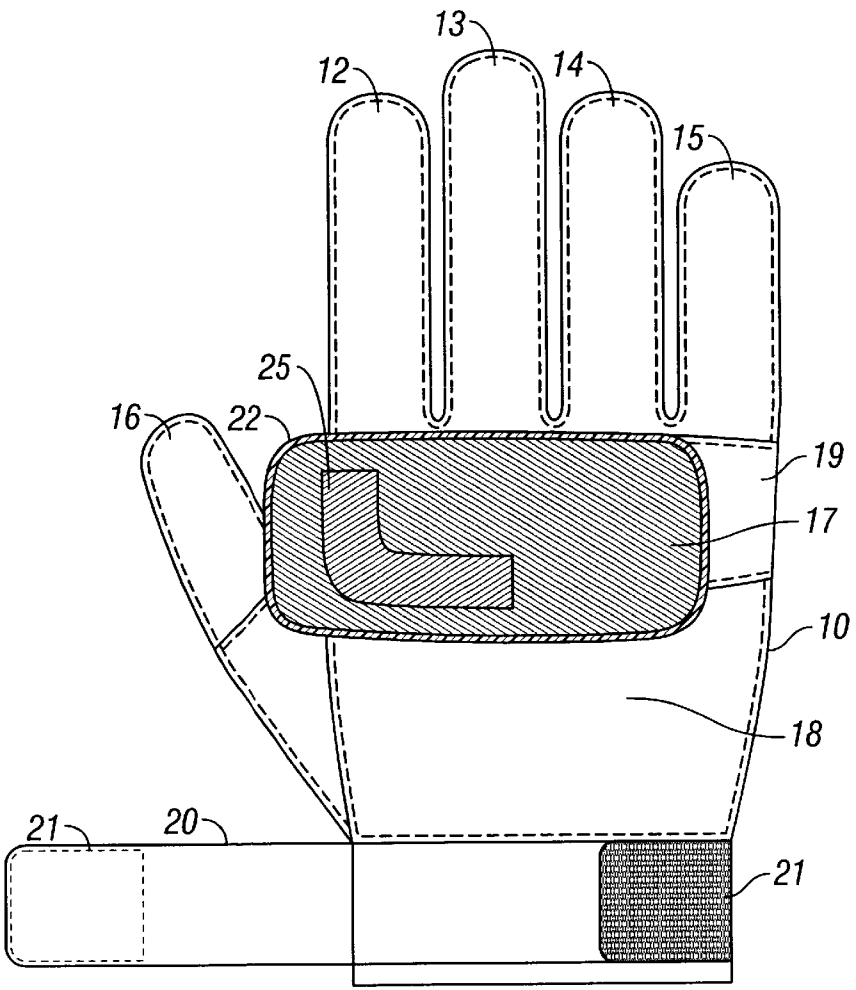
FIG. 1 is a front elevational view of a left-handed glove according to a first preferred embodiment of the present invention.
Figure 3:
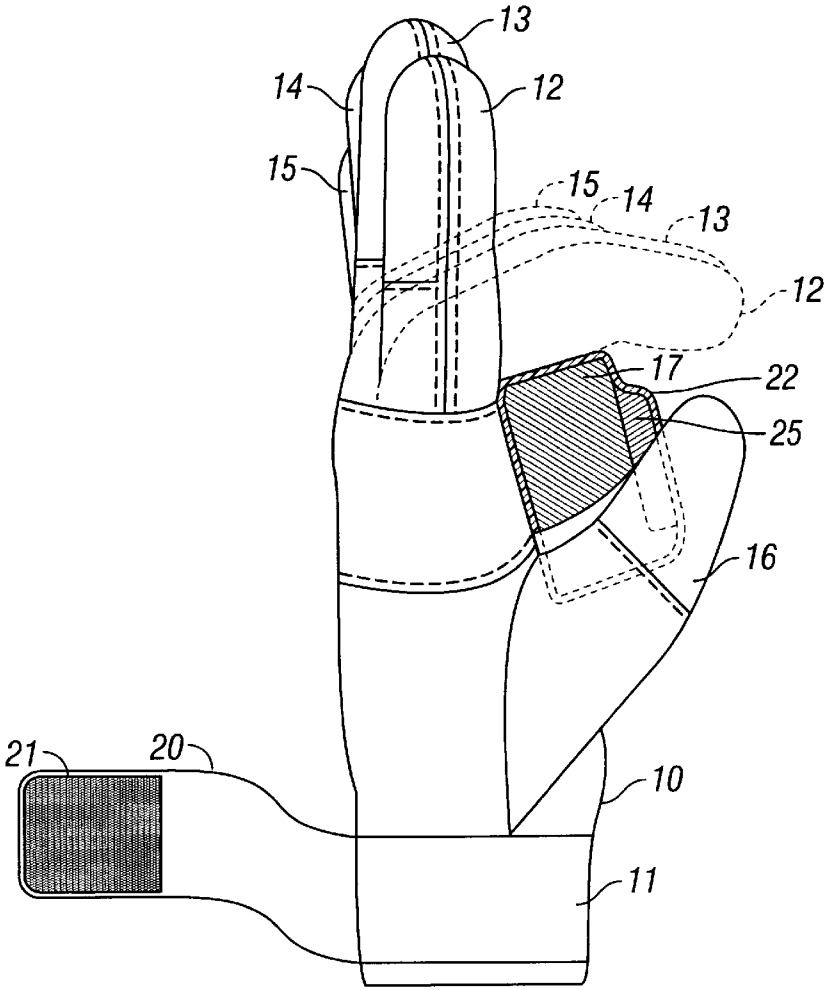
FIG. 3 is a side elevational view of the left-handed glove shown in FIG. 1.

With reference first to the preferred embodiment of the present invention illustrated in FIGS. 1–3, a hand covering 10 covers at least a portion of the wearer's hand, and has a limiting element 17 coupled thereto for inhibiting the wearer's ability to bring the thumb 16 into contact with the other fingers 12, 13, 14, 15. The limiting element 17 at least prevents a user to grasp objects between the thumb 16 and the other fingers 12, 13, 14, 15 (although some contact between these fingers may be possible). To this end, the shape and position of the limiting element 17 are important to the operation of the present invention and will be described in more detail below.

At a minimum, the hand covering 10 of the present invention serves the purpose of keeping the limiting element 17 in correct position with respect to the wearer's hand. To accomplish this function, the hand covering 10 is a glove that is worn upon the hand and to which the limiting element 17 is attached. The hand covering 10 can be shaped with compartments for multiple fingers (i.e., two or more) if desired. In the highly preferred embodiments shown in the figures, the hand covering 10 is a glove covering the wearer's fingers 12–16, palm, and back side of the hand. The hand covering 10 is preferably made from a durable material such as leather, canvas, or nylon, but can instead be made of any material used to make gloves, including without limitation cloth or fabric (woven or otherwise), rubber, nylon, wool, woven or non-woven synthetic material, etc. Any one or more of these materials can be used to make up the hand covering 10.

The hand covering 10 preferably has a front body portion 11 and a back body portion 18 which can be separate bodies of material coupled together in any conventional manner (e.g., by sewing, gluing, hot melting, weaving, by conventional fasteners such as snaps, buttons, hook and loop fastener material, and the like) with any desired material (e.g., thread, nylon, glue, and the like) along one or more seams. In highly preferred embodiments of the present invention, the front and back portion 11, 18 are sewn with nylon thread along seams adjacent to the edges of the wearer's hand. Of course, the seams can instead be in any other location on the hand as desired. Alternatively, the glove can be made of one body of material that is molded from rubber or other synthetic material, or that is woven, cast, etc. in any well known manner. The glove can also be made from more than two bodies of material connected in any well known manner as described above and using any material desired as also described above.

Depending upon where the front portion 11 of the hand covering 10 begins and where the rear portion 18 ends, it is possible to have one or more sections of the front portion 11 located on the sides of or even on the front of the wearer's hand, or to have one or more sections of the back portion 18 located on the sides of or even on the back of the wearer's hand. As such, reference hereinafter to the term "body portion 30" refers to one or both of the front and rear portions 11, 18.

The limiting element 17 is coupled to the body portion 30 of the hand covering 10 in a location interfering with the wearer's ability to touch the thumb 16 with the other fingers 12–15. Many different limiting element shapes and sizes can be used to accomplish this function, such as log, block, or wedge-shaped elements, or even elliptical, spherical, polygonal, or unusually-shaped elements. The limiting element 17 is preferably made of a resilient and pliable material. Highly preferred embodiments employ OLETEX brand closed cell foam for the limiting element 17, but any resilient foam material capable of yielding under pressure can instead be used. Foam material is preferred for the limiting element 17 because it is light and is less likely to cause injury to the wearer or to others (acting generally as a pad or cushion in addition to a motion limiting element). However, other materials can still be used to limit finger motion as described above, including without limitation sponge material, rubber (foam or otherwise), urethane, a fluid-like material (gel, liquid, sand, beads, pellets, etc.) encased in a plastic, foil, composite, or other casing in any conventional manner, rolled or stacked strips of cloth or fabric, cotton, wool, down or other stuffing, etc. Also, the limiting element 17 need not be a single element. If desired, the limiting element 17 can comprise multiple elements of any type described herein, attached to the body portion 30 as described above, and possibly attached to one another in any conventional manner for strength and durability.

It is also possible to employ limiting elements 17 made from multiple materials, such as layered foams of different types, a fluid-like material surrounded by padding, a rubber core encased in foam material, and the like. Most preferably, the limiting element 17 is made from a foam material (as described above) encased in a cover 22. The cover 22 is preferably made from the same material as the hand cover 10, and is more preferably made from durable leather. However, any one or more of the hand covering materials mentioned above can be used for the cover 22. The cover 22 can be attached to the limiting element 17 in any conventional manner depending at least in part upon the type of material used for the limiting element 17 and the cover. These manners of connection include without limitation gluing, sewing, taping, attaching with conventional fasteners, and the like. Most preferably, adhesive or cohesive material is used to attach the cover 22 to the limiting element 17.

The cover 22 preferably surrounds the limiting element 17 on all sides, and thereby helps to keep moisture from collecting inside the cover 22 and in the limiting element 17. However, it will be appreciated that the cover 22 need not necessarily entirely cover the limiting element 17, but can instead cover only one or more selected portions thereof. Less preferred embodiments of the present invention do not even have a cover 22 for the limiting element 17.

The cover 22 also preferably serves the function of attaching the limiting element 17 to the body portion 30. Specifically, the cover 22 is preferably attached to the body portion 30 in any conventional manner (including without limitation those described above for coupling the front and back portions 11, 18 of the hand covering 10). Most preferably, the cover 22 is attached to the body portion 30 with nylon thread sewn along the edges of the cover 22 adjacent to the body portion 30. The cover 22 is therefore preferably attached to the body portion 30 along multiple seams to ensure durability.

Attachment of the cover 22 to the body portion 30 secures the limiting element 17 to the body portion 30. The cover 22 at least surrounds enough of the limiting element 17 to perform this function, but more preferably enough to prevent shifting and movement of the limiting element 17 with respect to the body portion 30. Although a fully enclosed limiting element 17 is most preferred, these functions can be performed without such structure. It should be noted that if the cover 22 surrounds the limiting element 17 enough to prevent escape of the limiting element 17 therefrom, it can be unnecessary to attach the limiting element 17 to the cover 22 or to the body portion 30. In addition, the cover 22 can trap the limiting element 17 between itself and the body portion 30 if desired, in which case the limiting element 17 also does not necessarily need to be attached to the cover 22 or to the body portion 30.

Where a cover 22 is not used (such being optional as mentioned above), the limiting element 17 can be attached directly to the body portion 30 in a number of different well-known manners, including those described above with reference to the attachment of the cover 22 to the limiting element 17. In this regard, one or more stitches or fasteners can be passed directly through the limiting element 17 and body portion 30 in some embodiments to effect this attachment.

The limiting element 17 is preferably permanently attached to the body portion 30 in the manner as described above. However, alternative embodiments of the present invention employ removable and replaceable limiting elements 17. These limiting elements 17 employ conventional releasable fasteners to detach the limiting elements 17 from the body portion 30. Such releasable fasteners include without limitation one or more bands or pads of hook and loop fastener material, snaps, clips, buttons, ties, elastic bands, zippers, and the like. Such releasable fasteners can be used to attach a back surface of the cover 22 (and/or limiting element 17) to the surface of the body portion 30 in one or more locations, to wrap around the limiting element 17 (with or without cover 22) to thereby hold it against the body portion 30, etc. In these alternative embodiments, the limiting element 17 can be removed to permit the wearer to use the hand covering 10 simply as a glove, or even to replace the limiting element 17 with a limiting element of a different size more suitable for the wearer's hand size. Where a cover 22 is used as described above, the cover 22 and limiting element 17 can be removable from the hand covering 10 as an integral unit, or the cover 22 can be opened (e.g., by one or more releasable fasteners such as those mentioned above) to permit access to, removal of, and replacement of the limiting element 17.

As mentioned above, many different limiting element shapes and sizes can be used to interfere with the wearer's ability to touch the thumb 16 with the other fingers 12–15. Excellent results are achieved when the limiting element 17 is made large enough to interfere with the wearer's ability to grasp with the fingers but not so large as to prevent use of the fingers altogether (such as for holding a ball, if necessary). A limited ability to use the fingers for manipulation is most preferred but is not required to practice the present invention. To this end, virtually any shape of limiting element can be used to interfere with the above-described grasping motion, but the inventor has discovered that certain limiting element shapes and sizes strike a superior balance between interference with grasping and a limited ability to manipulate with the fingers. One such limiting element shape is shown by way of example in FIGS. 1 and 3.

The limiting element 17 shown in FIGS. 1 and 3 preferably has a generally crescent or arc-shaped raised portion 25 with a convex section facing the wearer's thumb 16. Preferably, this raised portion 25 extends from a position adjacent to the base of the thumb 16 on the front of the wearer's hand, down the front of the wearer's hand a distance near or partially over the edge of the hand adjacent to the thumb 16, and to an interior position of the wearer's palm. Though preferably generally crescent or arc-shaped, similar shapes such as L, C, J, V, or U-shaped raised portions similarly positioned on the limiting element 17 can be used to achieve similar results. Most preferably, the raised portion 25 just described is thicker in a portion immediately adjacent to the thumb 16 (preferably near the center of the raised portion 25 as shown in FIG. 1) than it is at its ends. The ends preferably taper to the primary top surface of the limiting element 17.

Whether having one or both tapered ends as just described, this shape of the raised portion 25 on the limiting element 17 has been found to be effective at preventing grasping between the thumb 16 and other fingers 12–15 while still permitting a significant degree of finger motion. Highly preferred embodiments of the present invention employ a limiting element 17 having a length of between 3¼" and 4½", a width of between 2" and 3", a primary thickness of between ¾" and 1¼", and a thickness at the raised portion 25 of between 1¼" and 1¾" for an average adult's hand. More preferably, the limiting element length is about 3¾" to 4", the limiting element width is about 2½", the primary thickness of the limiting element 17 is about 1", while the thickness at the raised portion 25 is about 1½" for an average adult's hand. Of course, these dimensions can be modified for smaller-than-average or larger-than-average hands or to change the movement restriction upon the fingers as desired.

Figure 4:
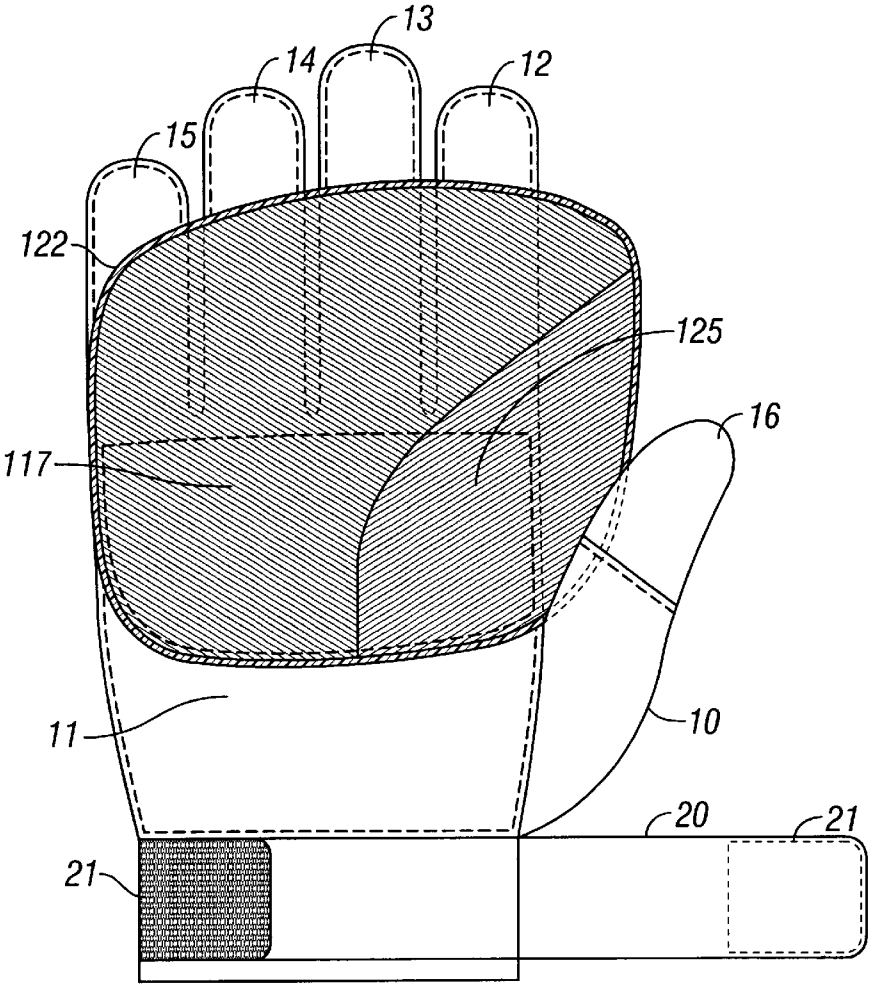
FIG. 4 is a front elevational view of right-handed glove according to a second preferred embodiment of the present invention.
Figure 6:
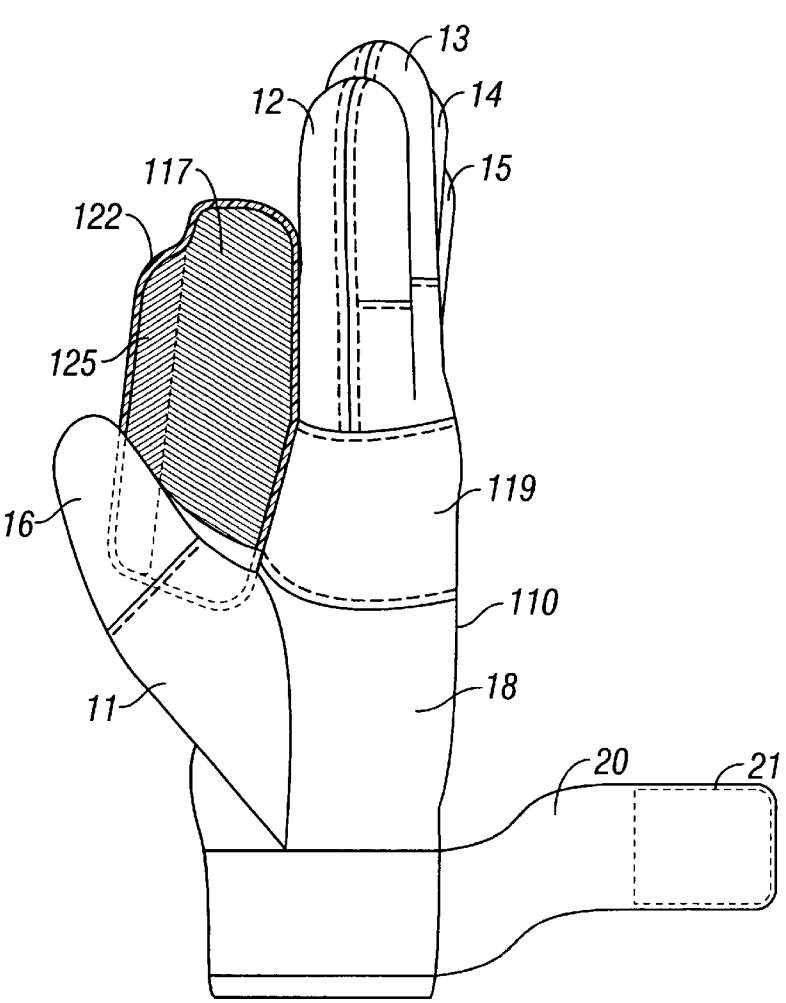
FIG. 6 is side elevational view of the glove shown in FIGS. 4 and 5.
Figure 5:
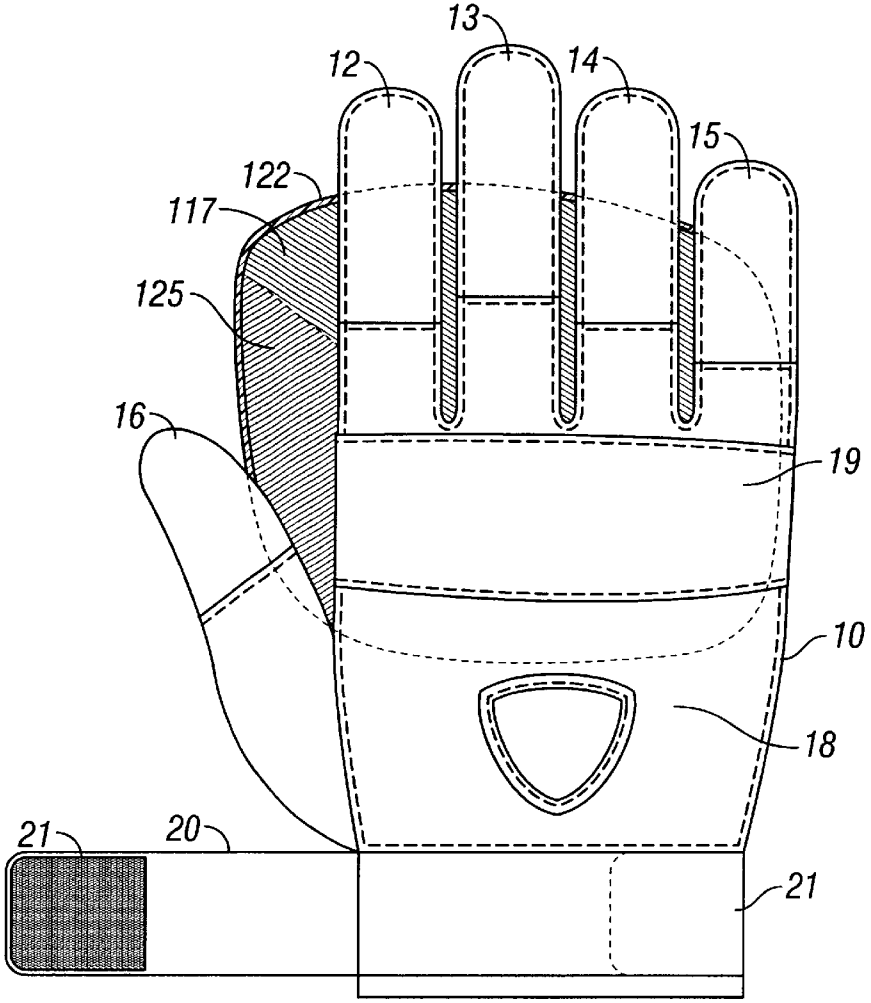
FIG. 5 is a back elevational view of the glove shown in FIG. 4.

Another highly preferred limiting element shape is illustrated by way of example in FIGS. 4–6. The limiting element 117 in this embodiment preferably also employs an increased limiting element thickness adjacent to the wearer's thumb 16. However, the raised portion 125 in this embodiment is an edge portion of the limiting element 117 preferably extending from a position between the thumb 16 and the index finger 12 (when the hand is in a relaxed position) to an interior position on palm of the wearer's hand. This raised portion can take any shape, such as generally straight, curved toward or away from the wearer's thumb 16, etc., but is preferably shaped to substantially match the edge of the limiting element 117 adjacent to the thumb 16. If desired, the edges or ends of this raised portion 125 can be tapered as in the preferred embodiment illustrated in FIGS. 1–3. The preferred embodiment of FIGS. 4–6 can have a varying raised portion thickness to better adapt to thumb mobility. Specifically, the area of the raised portion 125 near the wearer's palm can be (and most preferably is) somewhat thinner than the area of the raised portion 125 adjacent to the thumb 16.

Whether having one or both ends tapered or whether the raised portion otherwise has varying thickness as just described, this shape of the raised portion 125 on the limiting element 117 has been found to be effective at preventing grasping between the thumb 16 and other fingers 12–15 while still permitting finger motion. To illustrate another manner in which to limit the movement of the fingers 12–15 opposite the thumb 16, the preferred embodiment shown in FIGS. 4–6 employs a larger limiting element than the embodiment of FIGS. 1–3. This larger limiting element 117 can be used to decrease the ability of a user to bend his or her fingers into a grasping position. By increasing the width of the limiting element 117 to cover at least a portion of the front of the fingers 12–15 (and in less preferred embodiments, substantially the entire front of the fingers 12–15), the wearer is even less able to grasp with the fingers. This width can be increased or decreased depending upon wearer taste, the amount of finger movement desired, and for different hand and finger sizes.

Where a hand covering 110 in the form of the preferred embodiment illustrated in FIGS. 4–6 is used, limiting elements having a length of between 4½" and 5½", a width of between 3" and 5", a primary thickness of between ½" and 1", and a thickness at the raised portion 125 of between 1¼" and 2" for an average adult's hand are used. More preferably, the limiting element length is about 4½" to 5", the limiting element width is about 4", the primary thickness of the limiting element 117 is about ¾" while the thickness at the raised portion 125 increases from about 1½" near the wearer's palm to about 1¾" near the wearer's thumb 16 for an average adult's hand. Of course, these dimensions can be modified for smaller-than-average or larger-than-average hands or to change the movement restriction upon the fingers as desired.

Figure 7:
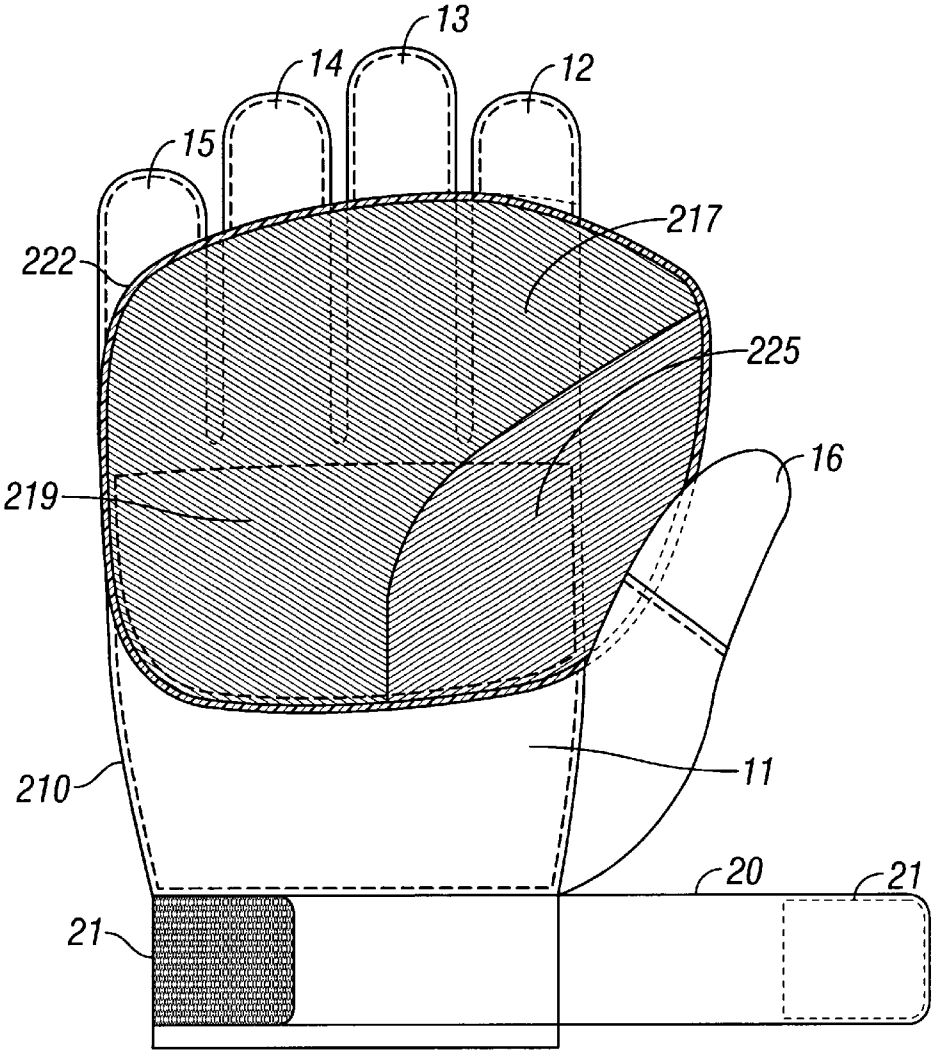
FIG. 7 is front elevational view of a right-handed glove according to a third preferred embodiment of the present invention.

Yet another highly preferred limiting element shape is shown by way of example in FIG. 7. This hand covering embodiment is much the same as that shown in FIGS. 4–6, with the following exceptions. Rather than have a limiting element that overlies a significant portion of the front of the wearer's hand (such as in the hand covering embodiment of FIGS. 4–6), the limiting element 217 can be located substantially only along the area of the raised portion 125 in the hand covering embodiment of FIGS. 4–6. As such, the limiting element of FIG. 7 is substantially the same shape and is preferably substantially the same thickness as the portion of the limiting element 117 (in the embodiment shown in FIGS. 4–6) that is raised. Preferably, the limiting element 217 has a cover 222 such as that described above in the first preferred embodiment of the present invention. This cover 222 extends over the same portion of the front of the hand covering 210 as the limiting element 217 of the second preferred embodiment (and therefore preferably shares similar length and width dimensions). This limiting element embodiment has the advantage of preventing movement of the thumb 16 and fingers 12–15 together while permitting an increased degree of articulation of the fingers 12–15 opposite the thumb 16 in comparison to the second preferred embodiment shown in FIGS. 3–6.

The limiting elements 17, 117, 217 described above and illustrated in the figures can have raised portions 25, 125, 225 that are separate from the main body of the limiting element 17, 117, 217 and trapped in place thereupon by the cover 22, 122, 222, or secured in place upon the main body and/or cover 22, 122, 222 in any conventional manner (by stitching, gluing, attaching with one or more conventional fasteners, and the like). In such case, the raised portions 25, 125, 225 can be made from a different material than the rest of the limiting element 17, 117, 217 if desired. Most preferably, however, the raised portions 25, 125, 225 are integral with the rest of the limiting element 17, 117, 217, and are molded, expanded, shaped, or otherwise formed as part of the limiting element 17, 117, 217 in any conventional manner.

It should be noted that the highly preferred limiting element shapes and sizes described above and illustrated in the figures are presented by way of example and illustration only, and not by way of limitation. As mentioned earlier, the limiting element 17, 117, 217 can be virtually any shape and size capable of interfering with the wearer's ability to bring the thumb 16 together with the other fingers 12–15 to grasp objects. Such shapes include without limitation log, block, wedge-shaped, elliptical, spherical, polygonal, or abnormally-shaped elements.

The hand covering 10, 110, 210 of the present invention is a glove as described above, with the limiting element 17, 117, 217 either directly or indirectly (via a cover 22, 122, 222) attached to the body portion as described above. Although a hand covering 10, 110, 210 that substantially fully or fully covers the hand of the wearer is most preferred, it is possible to employ hand coverings that cover only a portion of the wearer's hand while still maintaining the limiting element 17, 117, 217 in place on the hand. For example, the hand covering 10, 110, 210 need not necessarily cover the entire four fingers 12–15 opposite the thumb 16 in some embodiments. In other embodiments, the hand covering can leave these same fingers 12–15 uncovered, in which case the limiting element 17, 117, 217 is attached to that portion of the hand covering 10, 110, 210 that covers the base of these fingers 12–15 and/or the palm. In still other embodiments, the hand covering 10, 110, 210 can be as little as a body of hand covering material surrounding at least the index 12 and middle fingers 13 (or the bases thereof), but more preferably the bases of all four fingers 12–15 opposite the thumb 16. This type of hand covering is arranged somewhat like a set of brass knuckles, bringing the limiting element attached thereto into place between the thumb 16 and the other fingers 12–15 when the hand is closed or when the wearer attempts to bring the thumb 16 into contact with the other fingers 12–15. In any of these hand covering embodiments, the thumb 16 is preferably at least partially covered for increased stability of the device, but can be left uncovered if desired. If covered, the brass knuckles type of hand covering just described can cover just the index finger 12 and the thumb 16 (or at least the bases thereof), if desired.

Although finger movement for the purposes of grasping as described above can be accomplished by attaching the thumb and other finger portions of the hand covering 10, 110, 210 to the limiting element 17, 117, 217, the inventor has discovered that superior performance results from a hand covering 10, 110, 210 in which at least the thumb or at least one of the fingers 12–15 opposite to the thumb is not fully attached to the limiting element 17, 117, 217 and is thereby somewhat or entirely free to move with respect thereto. In highly preferred embodiments of the present invention, all of the wearer's fingers 12–16 are somewhat free to move with respect to the limiting element 17, 117, 217 and most preferably are substantially free to move with respect to the limiting element 17, 117, 217 (which is in such cases preferably attached below the portion of the hand covering 10, 110, 210 located over the palm and adjacent to the base of the wearer's fingers 12–15 opposite the thumb 16 and/or to the portion of the hand covering 10, 110, 210 located over the wearer's palm).

Preferably, the limiting element 17, 117, 217 is attached as described above to at least one of the hand covering portion covering the thumb 16, the hand covering portion covering one or more of the fingers 12–15 opposite the thumb (this portion being made of one or more hand covering portions that need not be connected together in one piece), and the hand covering portion covering the palm. Most preferably, the limiting element 17, 117, 217 is attached as described above to no more than two of these hand covering portions.

To increase the strength of the hand covering 10, 110, 210 and to add more stability and strength to the connection between the limiting element 17, 117, 217 and the body portion 30, 130, 230, additional material 19, 119, 219 can be attached to the hand covering 10, 110, 210 adjacent to the limiting element 17, 117, 217. If employed, this additional material 19, 119, 219 is most preferably located between the limiting element 17, 117, 217 and the body portion 30, 130, 230. This additional material 19, 119, 219 can be located on just the front or back of the hand covering 10, 110, 210, but more preferably passes about the front and back of the hand covering 10, 110, 210.

In highly preferred embodiments of the present invention, this additional material 19, 119, 219 is in the form of strapping extending fully around the hand covering 10, 110, 210 just below the base of the fingers 12–15 opposite the thumb 16, but can be extended to also or instead cover the fingers 12–15 opposite the thumb 16 either individually or as a group. This strapping 19, 119, 219 is preferably attached to the hand covering 10, 110, 210 in any conventional manner such as those described above with reference to the connection between the cover 22, 122, 222 and the body portion 30, 130, 230. Also, this strapping 19, 119, 219 can be made from any material desired, but is preferably made from a rugged and resilient material (such as those described above with reference to the hand covering materials), and most preferably is made of rawhide or leather. Preferably, the strapping 19, 119, 219 is attached at the edges of the body portion 30, 130, 230 along the edges of the wearer's hand and along seams running across the base of the fingers and the palm of the player's hand. Where such additional reinforcing material 19, 119, 219 is used, the limiting element 17, 117, 217 can be directly or indirectly attached thereto in a similar manner as described above with regard to limiting element attachment to the body portion 30, 130, 230, or can be attached to both the hand covering 10, 110, 210 and the reinforcing material 19, 119, 219 in a similar fashion.

It may be desirable to further secure the hand cover 10, 110, 210 to the wearer's hand, and to this end any conventional securement devices can be used as desired. For example, a wrist strap 20, 120, 220 can be attached in any conventional fashion to a portion of the hand cover 10, 110, 210 at or adjacent to the wearer's wrist as shown in the figures. This strap 20, 120, 220 preferably has a conventional fastener 21, 121, 221 for use in attaching the strap 20, 120, 220 in a range of tightnesses about the wearer's wrist. Possible conventional fasteners for the strap 20, 120, 220, include without limitation snaps, buckles, hook and loop fastener material pads, magnets, buttons, clips, and the like. Other well-known elements and devices for retaining hand coverings upon hands can instead or also be used, including without limitation an elastic wrist band, laces, ties, or snaps attached to the hand cover 10, 110, 210 at or adjacent to the wearer's wrist.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

I claim:

1. A hand covering for at least partially covering a wearer's hand, the hand covering comprising: a body portion having a palm portion, including an upper palm portion, a plurality of finger portions, and a thumb portion, and a limiting element coupled to the upper palm portion, the limiting element substantially unconnected to said plurality of finger portions and positioned to interfere with contact between the wearer's thumb and other fingers.

2. The hand covering as claimed in claim 1, wherein the limiting element at least partially covers the plurality of fingers.

3. The hand covering as claimed in claim 1, wherein the limiting element is made from resilient deformable material.

4. The hand covering as claimed in claim 1, wherein the limiting element has a raised portion that is thicker than other portions of the limiting element.

5. The hand covering as claimed in claim 4, wherein the raised portion is curved in shape.

6. The hand covering as claimed in claim 4, wherein the raised portion is located adjacent to the thumb.

7. The hand covering as claimed in claim 1, wherein the limiting element is made from a closed cell foam material.

8. The hand covering as claimed in claim 1, wherein the hand covering is a glove.

9. A hand covering for at least partially covering a wearer's hand, the hand covering comprising: a body portion having a palm portion, including an upper palm portion, a plurality of finger portions, and a thumb portion, and a limiting element coupled to the upper palm portion and one of a thumb portion and a finger portion, the limiting element positioned to interfere with contact between the wearer's thumb and other fingers.

10. The hand covering as claimed in claim 9, wherein the limiting element at least partially covers the plurality of fingers.

11. The hand covering as claimed in claim 9, wherein the limiting element at least partially covers the thumb.

12. The hand covering as claimed in claim 9, wherein the limiting element has a raised portion defining an area of increased limiting element thickness.

13. The hand covering as claimed in claim 12, wherein the raised portion is arc-shaped.

14. The hand covering as claimed in claim 9, wherein the limiting element is substantially block shaped.

15. The hand covering as claimed in claim 9, wherein the limiting element is made from a resilient deformable material.

16. The hand covering as claimed in claim 9, wherein the limiting element has an area of increased thickness adjacent to the thumb.

17. A method of using a hand covering at least partially covering a wearer's hand having a palm, a plurality of fingers, and an opposable thumb, the method comprising the steps of:

at least partially covering at least one of the palm and the plurality of fingers; and interfering with contact between the thumb and the plurality of fingers via a limiting element coupled to a body of the hand covering, the plurality of fingers at least partially free from the limiting element.

18. The method as claimed in claim 17, wherein the limiting element is coupled to a portion of the hand covering adapted to cover the thumb.

19. The method as claimed in claim 17, wherein the limiting element is a resilient deformable element.

* * * * *